US008313304B2

(12) United States Patent
Jocic

(10) Patent No.: US 8,313,304 B2
(45) Date of Patent: Nov. 20, 2012

(54) ON-DEMAND ON-OFF WATER PUMP ASSEMBLY

(75) Inventor: Radisav Jocic, Richmond Hill (CA)

(73) Assignee: Magna Powertrain, Inc., Concord (CA)

( * ) Notice: Subject to any disclaimer, the term of this patent is extended or adjusted under 35 U.S.C. 154(b) by 363 days.

(21) Appl. No.: 12/612,702

(22) Filed: Nov. 5, 2009

(65) Prior Publication Data

US 2010/0111723 A1 May 6, 2010

Related U.S. Application Data

(60) Provisional application No. 61/111,389, filed on Nov. 5, 2008.

(51) Int. Cl.
*F04B 49/00* (2006.01)

(52) U.S. Cl. ..... 417/15; 417/32; 417/223; 417/362; 123/41.44

(58) Field of Classification Search ..... 417/362, 417/364, 15, 32, 223; 123/41.44
See application file for complete search history.

(56) References Cited

U.S. PATENT DOCUMENTS

| | | | | | |
|---|---|---|---|---|---|
| 2,254,592 | A | * | 9/1941 | Berkeley | 474/38 |
| 2,835,238 | A | * | 5/1958 | Oehrli | 123/561 |
| 2,875,746 | A | * | 3/1959 | Brice et al. | 123/195 A |
| 3,785,220 | A | * | 1/1974 | Jacobs | 474/110 |
| 4,079,715 | A | | 3/1978 | Masaki et al. | |
| 4,158,248 | A | * | 6/1979 | Palmer | 15/321 |
| 4,277,240 | A | * | 7/1981 | Kraft | 474/110 |
| 4,445,583 | A | * | 5/1984 | Mazur | 180/68.1 |
| 4,475,485 | A | | 10/1984 | Sakakibara et al. | |
| 4,493,293 | A | | 1/1985 | Paul et al. | |
| 4,502,345 | A | * | 3/1985 | Butterfield | 74/336 B |
| 4,969,857 | A | * | 11/1990 | Kumm | 474/49 |
| 5,076,216 | A | | 12/1991 | Ro | |
| 5,112,281 | A | * | 5/1992 | Minato et al. | 474/84 |
| 5,176,581 | A | * | 1/1993 | Kumm | 474/110 |
| 5,603,289 | A | * | 2/1997 | Kwan | 123/41.46 |
| 6,318,307 | B1 | * | 11/2001 | Heer | 123/41.44 |
| 6,352,055 | B1 | * | 3/2002 | Algrain et al. | 123/41.44 |
| 6,561,141 | B2 | | 5/2003 | Stretch et al. | |
| 6,561,770 | B2 | * | 5/2003 | Okuda | 417/223 |
| 6,672,919 | B1 | * | 1/2004 | Beson | 440/89 R |
| 6,868,925 | B2 | * | 3/2005 | Trefz et al. | 180/53.4 |
| 7,028,677 | B2 | * | 4/2006 | Martin | 123/559.1 |
| 7,296,543 | B2 | | 11/2007 | Namuduri et al. | |
| 2002/0123401 | A1 | * | 9/2002 | Henry | 474/101 |
| 2004/0223856 | A1 | * | 11/2004 | Rembold et al. | 417/222.2 |
| 2006/0231059 | A1 | * | 10/2006 | Suzuki et al. | 123/197.4 |
| 2007/0137593 | A1 | * | 6/2007 | Di Giacomo et al. | 123/41.44 |

* cited by examiner

*Primary Examiner* — Devon Kramer
*Assistant Examiner* — Thomas Fink
(74) *Attorney, Agent, or Firm* — Harness, Dickey & Pierce, P.L.C.

(57) ABSTRACT

A water pump assembly for an internal combustion engine including a housing, as well as first and second rotatable shafts supported by the housing. First and second pulleys are fixed for rotation with the first and second shafts, respectively. A pumping member is fixed for rotation with the second shaft. A flexible member engages the first and second pulleys and is sized to slip relative to one of the first and second pulleys when in an unloaded state. A control mechanism selectively applies a load to the flexible member to cease the slipping and drivingly interconnect the first and second pulleys to rotate the pumping member.

18 Claims, 1 Drawing Sheet

ON-DEMAND ON-OFF WATER PUMP ASSEMBLY

CROSS-REFERENCE TO RELATED APPLICATIONS

This application claims the benefit of U.S. Provisional Application No. 61/111,389, filed on Nov. 5, 2008. The entire disclosure of the above application is incorporated herein by reference.

FIELD

The present disclosure relates to a cooling system for an automotive vehicle. More particularly, a simplified water pump control system is disclosed.

BACKGROUND

Typical internal combustion engine cooling systems include a water pump driven by a belt for circulating coolant through an engine block and a radiator. The pump is directly driven by the engine such that the rotational speed of the pump is directly proportional to that of the engine. Furthermore, the pump is driven continuously as long as the engine is operating. As such, coolant is circulated at all times including engine start up when the temperature of the engine may be less than a desired operating temperature. Prior to reaching the desired operating temperature, the engine may output increased undesirable emissions. Circulating cooling water immediately after engine start up may increase the time required for the engine to reach the desired operating temperature. Consequently, the quantity and duration of emissions production is greater than optimal. Furthermore, because the engine is operating for a longer period of time at a temperature less than the desired operating temperature, a cabin heating system may also require increased time to pump warm air toward the vehicle occupants.

Some automobiles have been equipped with magneto-rheological clutches to variably control the water pump regardless of engine operating speed. Unfortunately, these pump control systems are relatively heavy, complex and expensive. Accordingly, it may be desirable to provide a simplified, low-cost on/off water pump assembly.

SUMMARY

This section provides a general summary of the disclosure, and is not a comprehensive disclosure of its full scope or all of its features.

A water pump assembly for an internal combustion engine including a housing as well as first and second rotatable shafts supported by the housing. First and second pulleys are fixed for rotation with the first and second shafts, respectively. A pumping member is fixed for rotation with the second shaft. A flexible member engages the first and second pulleys and is sized to slip relative to one of the first and second pulleys when in an unloaded state. A control mechanism selectively applies a load to the flexible member to cease the slipping and drivingly interconnect the first and second pulleys to rotate the pumping member.

In another form, a pump assembly for an internal combustion engine includes a bracket adapted to be fixed to the internal combustion engine. A drive shaft is rotatably supported by the bracket. An input pulley is fixed for rotation with the drive shaft and adapted to be driven by the internal combustion engine. A drive pulley is fixed for rotation with the drive shaft. A pump shaft is rotatably supported by the bracket. A driven pulley is fixed for rotation with the pump shaft. A pumping member is fixed for rotation with the pump shaft such that rotation of the pump shaft and the pumping member causes a coolant flow. A flexible drive member encompasses the drive pulley and the driven pulley. A control mechanism selectively switches the pump assembly between ON and OFF modes of operation. During the OFF mode of operation the control mechanism spaces a loading member apart from the flexible drive member and the flexible drive member transfers a minimum magnitude of torque between the drive pulley and the driven pulley. In the ON mode of operation, the control mechanism engages the loading member with the flexible drive member to apply a load to the flexible member and transfer torque between the drive pulley and the driven pulley to drive the pumping member.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

An example embodiment will now be described more fully with reference to the accompanying drawings.

Figure 1:
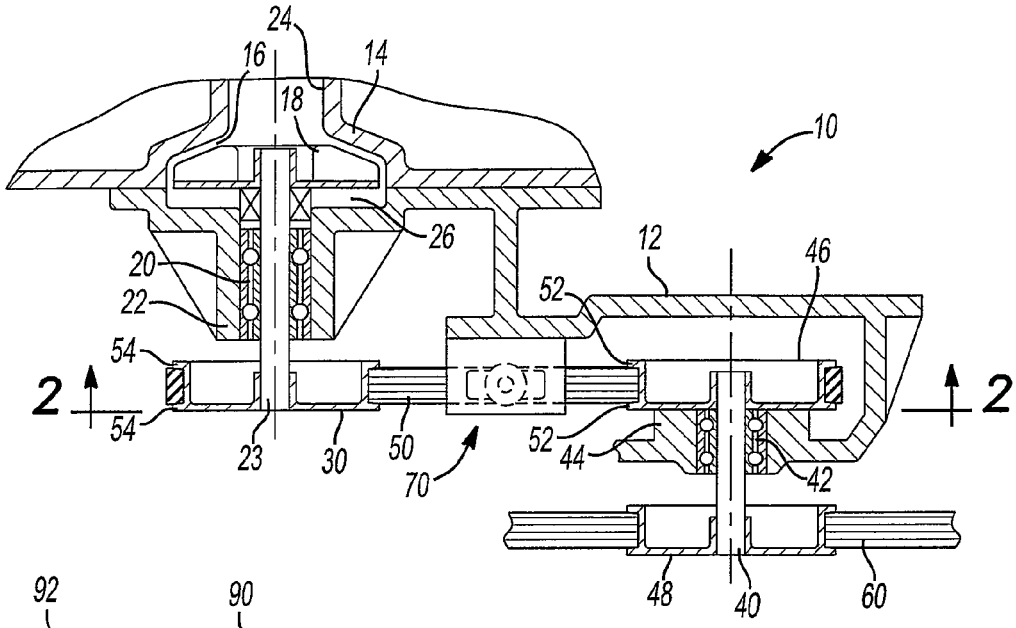
FIG. 1 is a fragmentary cross-sectional view of a water pump assembly constructed in accordance with the teachings of the present disclosure.

FIG. 1 depicts a fragmentary cross-sectional view of a water pump assembly 10 constructed in accordance with the teachings of the present disclosure. Water pump assembly 10 is configured to be coupled to an internal combustion engine (not shown) as a module in lieu of previously known water pump assemblies. Water pump assembly 10 includes a bracket 12 preferably constructed as a die-cast component from a relatively lightweight material such as aluminum. A cover 14 is fixed to bracket 12 to define a cavity 16. Coolant is pumped by a pumping member 18 rotatably supported within cavity 16. A bearing 20 is fitted within a cylindrical boss portion 22 integrally formed with bracket 12 to rotatably support a pump shaft 23 to which pumping member 18 is fixed. FIG. 1 depicts the pumping member as an impeller 18. It should be appreciated that other types of pumping members including gerotors, pistons, moveable vanes and the like may be used without departing from the scope of the present disclosure.

An inlet port 24 and an outlet port 26 are in communication with cavity 16. More particularly, low pressure fluid is drawn through inlet port 24 during rotation of impeller 18. Pressurized coolant is provided to outlet port 26 by rotating the pumping member 18. The pressurized fluid exiting outlet port 26 is plumbed in communication with the internal combustion engine to transfer heat generated during the combustion process from the engine to the radiator and then to atmosphere. Impeller 18 is fixed for rotation with one end of pump shaft 23. An opposite end of pump shaft 23 extends through boss portion 22 and is fixed for rotation with a driven pulley 30.

A drive shaft 40 is supported for rotation by a bearing 42 positioned within a substantially cylindrically shaped bearing support portion 44 integrally formed with bracket 12. Drive shaft 40 extends through bearing support portion 44 and includes a first end having a drive pulley 46 fixed for rotation thereto. An input pulley 48 is fixed for rotation with an opposite second end of drive shaft 40 such that input pulley 48 and drive pulley 46 rotate concurrently with one another. A flexible power transfer member such as a belt 50 encompasses drive pulley 46 and driven pulley 30. In the free state, belt 50 is sized such that little to no torque is transferred between drive pulley 46 and driven pulley 30 when drive pulley 46 is rotated. Belt 50 slips relative to at least one of drive pulley 46 and driven pulley 30. Drive pulley 46 includes upturned flanges 52 and driven pulley 30 includes upturned flanges 54 to assure that belt 50 maintains alignment with each pulley 46, 30 during all modes of operation. A main drive belt 60 continuously drivingly engages input pulley 48 and at least one other pulley powered by the internal combustion engine.

Figure 2:
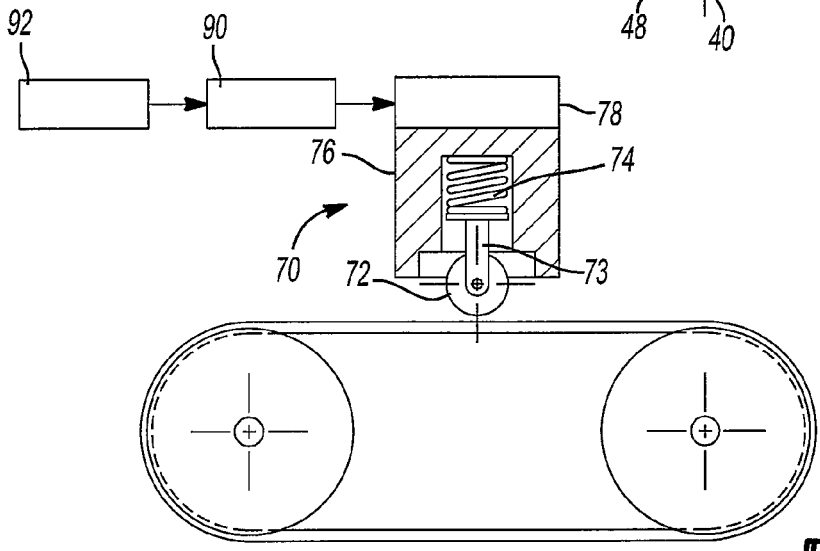
FIG. 2 is a schematic depicting the water pump assembly of FIG. 1 operating in an OFF mode.

A control mechanism 70 is operable to selectively operate water pump 10 in one of an "ON" or an "OFF" mode. As previously mentioned, belt 50, drive pulley 46 and driven pulley 30 are sized, spaced and configured to cooperate with one another such that no or only a minimum drive torque is transferred between drive shaft 40 and pump shaft 23. Use of water pump 10 in this manner may be termed as OFF mode operation. As shown in FIG. 2, control mechanism 70 includes an idler pulley 72 supported for rotation on an axially moveable idler rod 73. Idler pulley 72 is selectively drivingly engageable with belt 50 to cause torque transfer between drive shaft 40 and pump shaft 23. Control mechanism 70 is disengaged and spaced apart from belt 50 when water pump assembly 10 is operating on the OFF mode.

Figure 3:
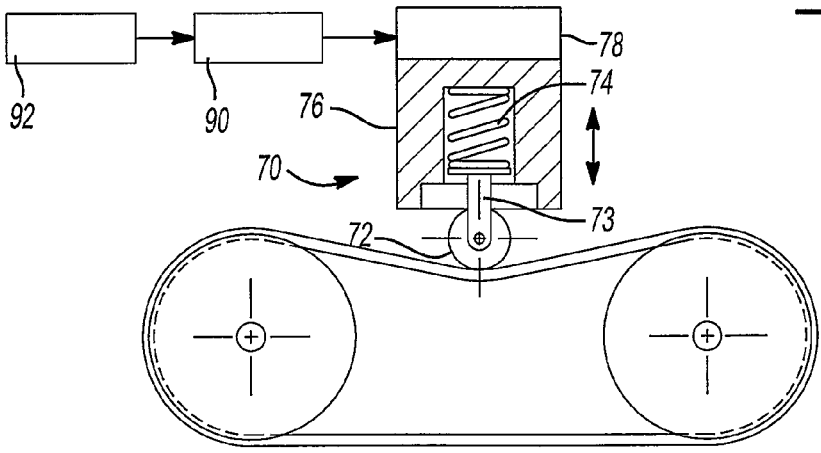
FIG. 3 is a schematic depicting the water pump assembly operating in an ON mode.

As shown in FIG. 3, control mechanism 70 is normally operable in the ON mode where a spring 74 positioned in a housing 76 biases idler pulley 72 into engagement with belt 50. No external power is required to operate water pump assembly 10 in the ON mode. Accordingly, the default mode of operation includes rotating impeller 18 and distributing coolant through the internal combustion engine when the engine is operating.

Control mechanism 70 includes an actuator 78 operable to axially displace idler rod 73 relative to housing 76 and disengage idler pulley 72 from belt 50. At this time, water pump assembly 10 operates in the OFF mode and coolant is not pumped by impeller 18. Actuator 78 may include any number of devices including an electrical solenoid, an electric motor coupled with a gear drive or power screw, a hydraulically pressurized cavity and piston arrangement or any other mechanism operable to axially displace idler rod 73. Housing 76 may be fixed to or integrally formed with bracket 12. Furthermore, it is contemplated that bracket 12 will include one or more flanges or other mounting provisions for fixing water pump assembly 10 to the internal combustion engine.

A controller 90 is operable to output a signal to actuator 78 to place control mechanism 70 in one of the ON or OFF modes. Controller 90 is also in communication with a plurality of sensors 92. It is contemplated that sensors 92 may be part of a previously existing engine control system or may be separately and individually associated with controller 90. Sensors 92 may include an engine coolant temperature sensor, a timer, an exhaust gas temperature sensor or any number of other sensors that may indicate that the internal combustion engine is operating at or near a predetermined operating temperature.

In operation, controller 90 determines if the internal combustion engine is operating below the predetermined operating temperature. If so, controller 90 signals actuator 78 to disengage idler pulley 72 from belt 50. At this time, even if the internal combustion engine is operating, pump shaft 23 will not be rotating or will be rotating at a very low speed. Accordingly, coolant will not be pumped by impeller 18 through the internal combustion engine. While the engine is running, the engine block, heads and other engine components as well as the coolant within the engine will heat relatively rapidly. The exhaust temperature will also increase. An increased exhaust temperature causes the catalytic converter to operate more efficiently and reduce engine emissions. Furthermore, the increased engine coolant temperature may be supplied to the cabin heating system and heat the passenger compartment. Once a predetermined value from one of the sensors has been met, controller 90 will signal actuator 78 to deactivate such that spring 74 drivingly engages idler pulley 72 with belt 50. Torque is now transferred from the internal combustion engine through main drive belt 60, input pulley 48, drive shaft 40, drive pulley 46, belt 50, driven pulley 30, the pump shaft 23 to impeller 18. Coolant is circulated through the engine and radiator until controller 90 requests a change in the water pump operating mode.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A water pump assembly for an internal combustion engine, the pump assembly comprising:

a bracket adapted to be fixed to the internal combustion engine;

a drive shaft rotatably supported by the bracket;

an input pulley being fixed for rotation with the drive shaft and adapted to be driven by the internal combustion engine;

a drive pulley fixed for rotation with the drive shaft;

a pump shaft rotatably supported by the bracket;

a driven pulley fixed for rotation with the pump shaft;

a pumping member fixed for rotation with the pump shaft such that rotation of the pump shaft and the pumping member causes a fluid flow;

a flexible drive member including a surface contacting adjacent surfaces of the drive pulley and the driven pulley;

a control mechanism for selectively switching the pump assembly between on and off modes of operation, wherein during the off mode of operation the control mechanism spaces a loading member apart from the flexible drive member and the flexible member transfers a minimum magnitude of torque between the drive pulley and the driven pulley as the flexible drive member surface slips relative to one of the adjacent pulley surfaces, in the on mode, the control mechanism engages the loading member with the flexible drive member to apply a load to the flexible member and transfer torque between the drive pulley and the driven pulley to drive the pumping member, wherein the control mechanism includes a spring biasing the loading member into engagement with the flexible drive member when the pump is operated in the on mode, the control mechanism also including an actuator operable to act against the spring and space the loading member apart from the flexible drive member.

2. The water pump assembly of claim 1 wherein the loading member includes an idler pulley supported for rotation on an axially moveable idler rod.

3. The water pump assembly of claim 2 wherein the control mechanism includes a housing fixed to the bracket for reacting the load from the spring.

4. The water pump assembly of claim 2 wherein the actuator linearly translates the idler rod.

5. The water pump assembly of claim 1 wherein the pumping member includes an impeller positioned within a cavity at least partially defined by the bracket.

6. The water pump assembly of claim 5 further including a removable cover fixed to the bracket to define another portion of the cavity.

7. The water pump assembly of claim 1 wherein the drive pulley and the driven pulley each include upturned flanges to retain the flexible member in position during operation in the OFF mode.

8. The water pump assembly of claim 1 wherein the drive shaft and the pump shaft are rotatably supported by bearings positioned within substantially cylindrically shaped boss portions integrally formed with the bracket.

9. A water pump assembly for an internal combustion engine, comprising:

a housing adapted to be fixed to the internal combustion engine;

first and second rotatable shafts supported by the housing;

first and second pulleys fixed for rotation with the first and second shafts, respectively;

a pumping member fixed for rotation with the second shaft;

a flexible member including a surface engaging adjacent surfaces on the first and second pulleys, the flexible member being sized such that the flexible member surface slips relative to one of the adjacent surfaces on the first and second pulleys when in an unloaded state; and a control mechanism including a spring for biasing a loading member into engagement with the flexible member to cease the slipping and drivingly interconnect the first and second pulleys to rotate the pumping member, wherein the control mechanism includes an actuator operable to act against the spring and space the loading member apart from the flexible drive member.

10. The water pump assembly of claim 9 wherein the loading member includes an idler pulley supported for rotation on an axially moveable idler rod.

11. The water pump assembly of claim 10 wherein the control mechanism is fixed to the housing for reacting the load from the spring.

12. The water pump assembly of claim 10 wherein the actuator linearly translates the idler rod.

13. The water pump assembly of claim 9 wherein the pumping member includes an impeller positioned within a cavity at least partially defined by the housing.

14. The water pump assembly of claim 13 further including a removable cover fixed to the housing to define another portion of the cavity.

15. The water pump assembly of claim 9 wherein the first pulley and the second pulley each include upturned flanges to retain the flexible member in position during operation.

16. The water pump assembly of claim 9 wherein the first shaft and the second shaft are rotatably supported by bearings positioned within substantially cylindrically shaped boss portions integrally formed with the housing.

17. The water pump assembly of claim 9 wherein the control mechanism includes a temperature sensor operable to output a signal indicative of the temperature of a pumpable fluid, the control mechanism applying the load to the flexible member once a predetermined temperature has been reached.

18. The water pump assembly of claim 17 wherein the sensor includes one of an engine coolant sensor, a timer and an exhaust gas temperature sensor.

* * * * *